US009044074B1

(12) United States Patent
De Freitas et al.

(10) Patent No.: US 9,044,074 B1
(45) Date of Patent: Jun. 2, 2015

(54) BULLETPROOF BACKPACK SYSTEMS

(71) Applicants: George Eduardo Almeida De Freitas, Laguna Hills, CA (US); Silvio Ricardo Almeida De Freitas, Salvador (BR)

(72) Inventors: George Eduardo Almeida De Freitas, Laguna Hills, CA (US); Silvio Ricardo Almeida De Freitas, Salvador (BR)

( * ) Notice: Subject to any disclaimer, the term of this patent is extended or adjusted under 35 U.S.C. 154(b) by 0 days.

(21) Appl. No.: 14/054,034

(22) Filed: Oct. 15, 2013

Related U.S. Application Data

(60) Provisional application No. 61/850,721, filed on Jan. 17, 2013.

(51) Int. Cl.
*A45C 15/00* (2006.01)
*F41H 1/02* (2006.01)
*F41H 5/00* (2006.01)

(52) U.S. Cl.
CPC . *A45C 15/00* (2013.01); *F41H 5/00* (2013.01); *F41H 1/02* (2013.01)

(58) Field of Classification Search
CPC ..... A45C 15/00; F41H 1/02; F41H 5/00
USPC ..... 224/576, 578, 584, 586
See application file for complete search history.

(56) References Cited

U.S. PATENT DOCUMENTS

| | | | | | |
|---|---|---|---|---|---|
| 4,266,297 | A * | 5/1981 | Atkins | 2/2.5 |
| 4,389,735 | A * | 6/1983 | McLaughlin | 2/94 |
| 4,830,245 | A * | 5/1989 | Arakaki | 224/628 |
| 5,060,314 | A * | 10/1991 | Lewis | 2/2.5 |
| 5,373,582 | A * | 12/1994 | Dragone et al. | 2/2.5 |
| 5,966,747 | A * | 10/1999 | Crupi et al. | 2/466 |
| 6,161,738 | A | 12/2000 | Norris | |
| 6,419,132 | B1 | 7/2002 | Reed | |
| 6,659,689 | B1 * | 12/2003 | Courtney et al. | 405/186 |
| 6,685,071 | B2 | 2/2004 | Prather | |
| 6,805,519 | B1 * | 10/2004 | Courtney | 405/185 |
| D498,585 | S * | 11/2004 | Darling | D3/216 |
| 7,424,748 | B1 * | 9/2008 | McDunn et al. | 2/2.5 |
| 7,441,278 | B2 | 10/2008 | Blakeley | |
| 7,917,968 | B2 * | 4/2011 | Roux | 2/2.5 |
| 7,926,117 | B2 * | 4/2011 | Parks et al. | 2/2.5 |
| 8,438,811 | B1 * | 5/2013 | Woodard et al. | 52/506.05 |
| 2009/0206115 | A1 * | 8/2009 | Gleason | 224/153 |

* cited by examiner

*Primary Examiner* — Brian D Nash
(74) *Attorney, Agent, or Firm* — RG Patent Consulting, LLC; Rachel Gilboy

(57) ABSTRACT

The bulletproof backpack system provides a rapidly deployable bulletproof vest and hood assembly, conveniently stored in a backpack. A deployment assembly provides rapid deployment and protection from flying projectiles, while the notification assembly allows notification, GPS positioning, and real time communication with proper authorities either through an activation button in a vest pouch or remotely through a hands-free headset device.

16 Claims, 5 Drawing Sheets

BULLETPROOF BACKPACK SYSTEMS

CROSS-REFERENCE TO RELATED APPLICATION

The present application is related to and claims priority from prior provisional application Ser. No. 61/850,721, filed Jan. 7, 2012 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

FIELD OF THE INVENTION

The present invention relates generally to the field of personal protection devices, and more specifically relates to a backpack containing a quickly deployable bulletproof vest.

DESCRIPTION OF THE RELATED ART

Personal body armor is designed to absorb and/or deflect slashing, bludgeoning, and penetrating attacks. It was historically used to protect soldiers, whereas today, it is also used to protect various types of police, private citizens, private security guards or bodyguards. Two types exist: regular non-plated personal armor (used by the people mentioned above, except combat soldiers) and hard-plate reinforced personal armor, which is used by combat soldiers, police tactical units and hostage rescue teams. A ballistic vest helps absorb the impact from firearm-fired projectiles and shrapnel from explosions, and is worn on the torso. Soft vests are made from many layers of woven or laminated fibers and can be capable of protecting the wearer from small caliber handgun and shotgun projectiles, and small fragments from explosives. A modern equivalent may combine a ballistic vest with other items of protective clothing, such as a combat helmet.

Due to unfortunate occurrences' in today's society involving weapons violence, people are at increased risk of such violence. The added security of a personal protection device, while not limiting and intruding on an individual's daily activities is desirable.

Various attempts have been made to solve the above-mentioned problems such as those found in U.S. Pat. No. 6,161,738 to Gail Norris; U.S. Pat. No. 6,685,071 to Jeffrey Prather, U.S. Pat. No. 7,441,278 to Kenneth Christopher Blakeley; and U.S. Pat. No. 6,419,132 to David K. Reed. This art is representative of personal protection devices. None of the above inventions and patents, taken either singly or in combination, is seen to describe the invention as claimed.

Ideally, a personal protection device should provide protection from projectiles, be user-friendly, quickly deployable and, yet would operate reliably and be manufactured at a modest expense. Thus, a need exists for a reliable bulletproof backpack system to provide personal safety, with the ability to be quickly deployed, and to avoid the above-mentioned problems.

BRIEF SUMMARY OF THE INVENTION

In view of the foregoing disadvantages inherent in the known personal safety art, the present invention provides a novel bulletproof backpack system. The general purpose of the present invention, which will be described subsequently in greater detail is to provide personal safety in case of flying projectiles, by deploying a bulletproof vest from a backpack.

A bulletproof backpack system is disclosed herein, in a preferred embodiment, comprising: a bulletproof backpack assembly having; a deployable bulletproof vest, and an attached bulletproof hood. It further comprises a deployment assembly having at least two pull handles, and a series of hook and loop fasteners. It further comprises a notification assembly having a software program, an alarm system, a transmitter and receiver system, a GPS system, and a hands-free headset, also known and sold under the tradename (Bluetooth™). The bulletproof backpack assembly comprises a vest assembly, a deployment assembly, and a notification assembly in functional combination. The vest assembly has a deployable bulletproof vest, and an attached bulletproof hood made of a hidden multilayered bulletproof material. It further comprises a pouch with hook and loop fasteners to store a hands-free headset (Bluetooth™) device capable of silently and remotely activating any authorized Smart phone App to a max range of 100 m (300 ft). A person looking or checking the Smart phone after the App is activated will not see any sign that the app is on or active. Upon activation, authorities as well 5 close contacts are contacted simultaneously and provided real time, precise GPS location, updated in 5 minute intervals. The entire system is intended to protect an individual in an urban, hiking, or travel situation. The bulletproof backpack system is available for children and/or adults. The attached bulletproof hood comprises hook and loop fasteners to secure the attached bulletproof hood to a user's head for protection from flying projectiles. The deployable bulletproof vest and attached bulletproof hood combine and make a single, wearable item, and can be incorporated into the design of any standard backpack.

A bulletproof backpack system is disclosed herein, in a preferred embodiment, comprising: a bulletproof backpack assembly having; a deployable bulletproof vest, and an attached bulletproof hood. It further comprises a deployment assembly having at least two pull handles, and a series of hook and loop fasteners. It further comprises a notification assembly having a software program, an alarm system (app contacting police/authorities and close ones all at once in real time), a transmitter and receiver system, a GPS system, and a keychain Bluetooth™ capable of activating the app remotely (no headset). The bulletproof backpack assembly comprises a vest assembly, a deployment assembly, and a notification assembly in functional combination. The vest assembly has a deployable bulletproof vest, and an attached bulletproof hood made of a hidden multilayered bulletproof material. It further comprises a pouch with hook and loop fasteners to store a keychain Bluetooth™ device capable of silently and remotely activating any-authorized Smart phone App to a max range of 100 m (300 ft). For security, a person looking or checking the Smart phone after the App is activated will not see any sign that the app is on or active. Upon activation, authorities as well 5 close contacts are contacted simultaneously and provided real time, precise GPS location, updated in 5 minute intervals. The entire system is intended to protect an individual in an urban, hiking, or travel situation. The bulletproof backpack system is available for children and/or adults. The attached bulletproof hood comprises hook and loop fasteners to secure the attached bulletproof hood to a user's head for protection from flying projectiles. The deployable bulletproof vest and attached bulletproof hood combine and make a single, wearable item, and can be incorporated into the design of any standard backpack.

The notification assembly comprises a software program, an alarm system, a transmitter system, a receiver system, a GPS system, and a hands-free headset (Bluetooth™) in communicative combination. The notification assembly is able to be activated with a button in the pouch of the vest assembly, and alternately allows a user to activate the system remotely with a button on the hands-free headset, which is capable of silently, and remotely activating any Smart phone App to a max range of 100 m (300 ft). Any person looking or checking the Smart phone after the App is activated will not see any sign that the app is on or active. The system is designed to notify surrounding authorities, as well 5 close contacts simultaneously, and provides real time, precise GPS location updated in 5 minute intervals. The entire system is intended to protect an individual in an urban, hiking, or travel situation. The bulletproof backpack system is available for children and adults. The notification assembly is able to work in conjunction with a hands-free headset to notify authorities of imminent danger to a user, and can also be remotely activated, per need of a user. The software program works in communicative communication with a transmitter system, a receiver system, a GPS system, and a hands-free headset, to allow transmission and reception of information from authorities when activated by a user. It allows a user to communicate with authorities and family members in real time upon activation of the notification assembly.

The user of a bulletproof backpack assembly is able to grip at least two pull handles, pulling to activate, and thereby deploying a vest assembly, allowing a user to attach the deployable bulletproof vest to the body of a user with a series of hook and loop fasteners. A GPS assembly is able to use the notification assembly to alert authorities of an urgent distress of a user with respect to location.

The present invention holds significant improvements and serves as a bulletproof backpack system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, bulletproof backpack system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a personal safety device and more particularly to a bulletproof backpack system as used to improve an individual's personal safety in the case of flying projectiles, and more importantly, in the case of weapons violence.

Generally speaking, the bulletproof backpack system of the present invention provides a rapidly deployable bulletproof vest and hood assembly, conveniently stored in a 'standard' backpack. A deployment assembly provides rapid deployment and protection from flying projectiles, while the notification assembly allows notification, GPS positioning, and real time communication with proper authorities.

Figure 1:
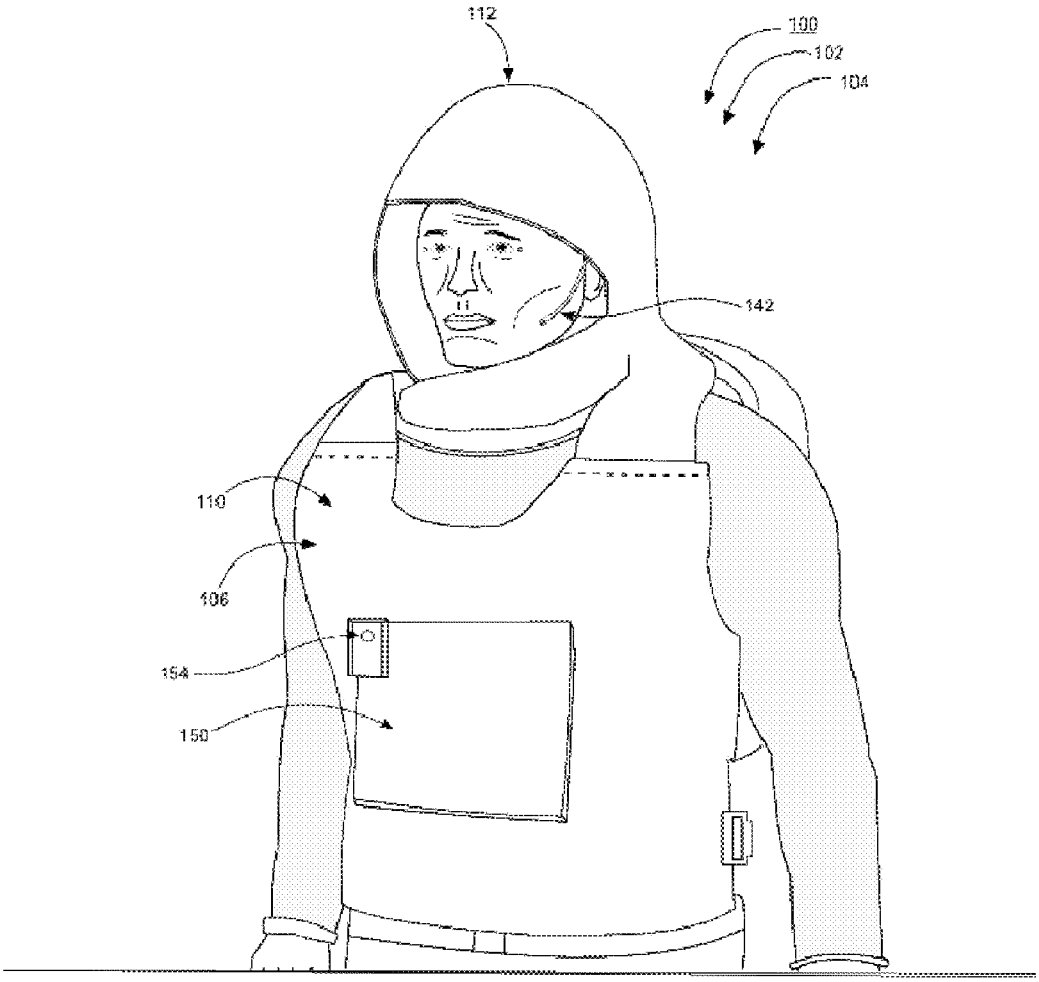
FIG. 1 shows a perspective view illustrating a bulletproof backpack system in an in-use condition according to an embodiment of the present invention.

Referring to the drawings by numerals of reference there is shown in FIG. 1, a perspective view illustrating an in-use condition 102 of bulletproof backpack system 100 according to an embodiment of the present invention.

Bulletproof backpack assembly 104 in a preferred embodiment comprises vest assembly 106 having deployable bulletproof vest 110, and attached bulletproof hood 112. It further comprises deployment assembly 115 having at least two pull handles 117, and series of hook and loop fasteners 119. It further comprises notification assembly 130 having software program 132, alarm system 134, transmitter system 136, and receiver system 138, GPS system 140, and hands free communication assembly 142. Bulletproof backpack assembly 104 comprises vest assembly 106, deployment assembly 115, and notification assembly 130 in functional combination. Vest assembly 106 has deployable bulletproof vest 110, and attached bulletproof hood 112 made of a hidden multilayered bulletproof material 107. It further comprises pouch 150 with hook and loop fasteners 151 to store hands free communication assembly 142 when not in use. Attached bulletproof hood 112 comprises hook and loop fasteners 152 to secure attached bulletproof hood 112 to a user's head for protection from flying projectiles. Deployable bulletproof vest 110 and attached bulletproof hood 112 combine and make a single, wearable item, and can be incorporated into the design of virtually any 'standard' backpack.

Figure 2A:
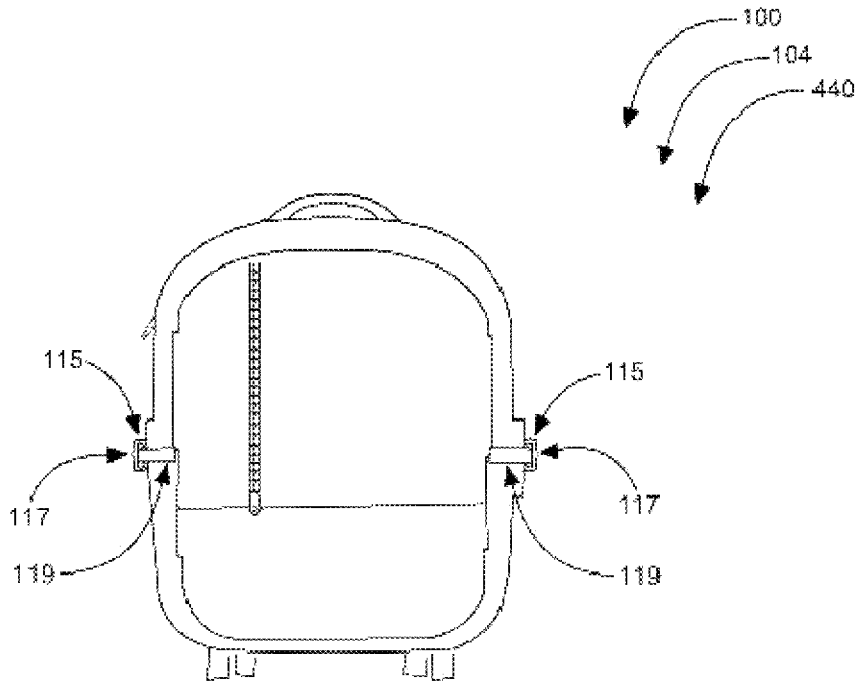
FIG. 2A is a perspective view illustrating a bulletproof backpack assembly in an undeployed condition according to an embodiment of the present invention of FIG. 1.
Figure 2B:
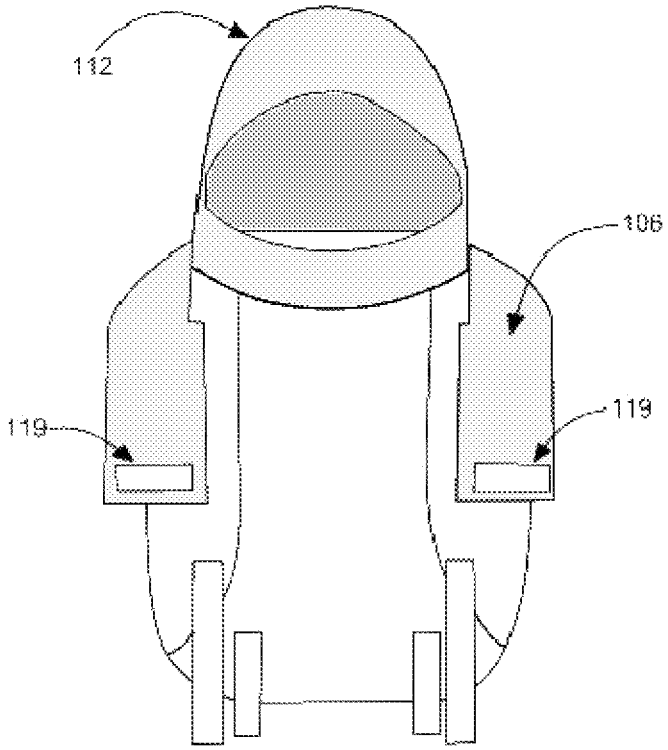
FIG. 2B is a perspective view illustrating the bulletproof backpack assembly in a deployed condition according to an embodiment of the present invention of FIG. 1.

Referring now to FIGS. 2A and 2B, a perspective view illustrating bulletproof backpack assembly 104 of bulletproof backpack system 100 in an undeployed condition and a deployed condition respectively, according to an embodiment of the present invention.

Bulletproof backpack assembly 104 is available in various colors to appeal to a wide variety of users, and appears as a standard backpack until deployed by a user. Bulletproof backpack assembly 104 is able to store items of a user's preference, while also having vest assembly 106 stored therein. Deployable bulletproof vest 110 and attached bulletproof hood 112 reside within bulletproof backpack assembly 104 until use is required, and is capable of protecting a user's vital organs and head when in use. Deployment assembly 115 comprises at least two pull handles 117 (preferably two) and series of hook and loop fasteners 119, two pull handles 117 comprising heavy duty suitable material for durability. Deployment assembly 115 allows a user to be able to deploy vest assembly 106 in a rapid, lifesaving manner.

Figure 3:
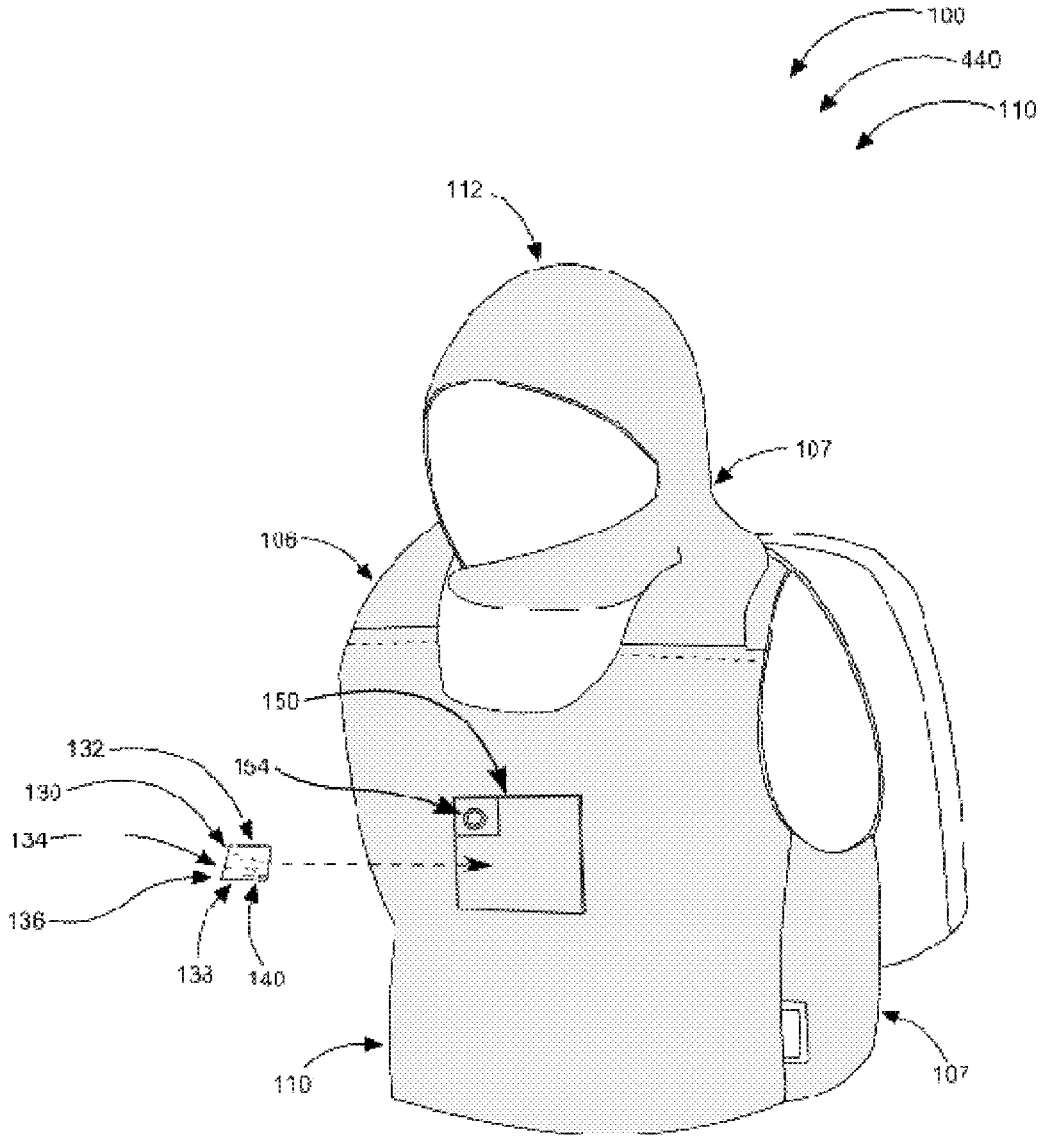
FIG. 3 is a perspective view illustrating the bulletproof backpack assembly with software program which may be used therewith according to an embodiment of the present invention of FIG. 1.

Referring now to FIG. 3, a perspective view illustrating bulletproof backpack assembly 104 with software program 132 (and embodiment for enabling it's use) according to an embodiment of the present invention.

Notification assembly 130 comprises software program 132, alarm system 134, transmitter system 136, receiver system 138, GPS system 140, and hands-free headset 142, (Bluetooth™) device in communicative combination. Notification assembly 130 is able to be activated with panic button 154 in pouch 150 of vest assembly 106, and alternately allows a user to activate the system remotely via hands-free headset 142. Notification assembly 130 is able to work in conjunction with hands-free headset 142 (Bluetooth™) to notify authorities of imminent danger to a user, and can also be remotely activated, per need of a user. Software program 132 works in communicative communication with transmitter system 136, receiver system 138, GPS system 140, and hands-free headset 142, to allow transmission and reception of information from authorities when activated by a user. It allows a user to communicate with authorities and family members in real time upon activation of notification assembly 130. Notification assembly 130 may also comprise other electronic features for functional communication with outside sources (such as remote connection to police station; base station or the like).

Figure 4:
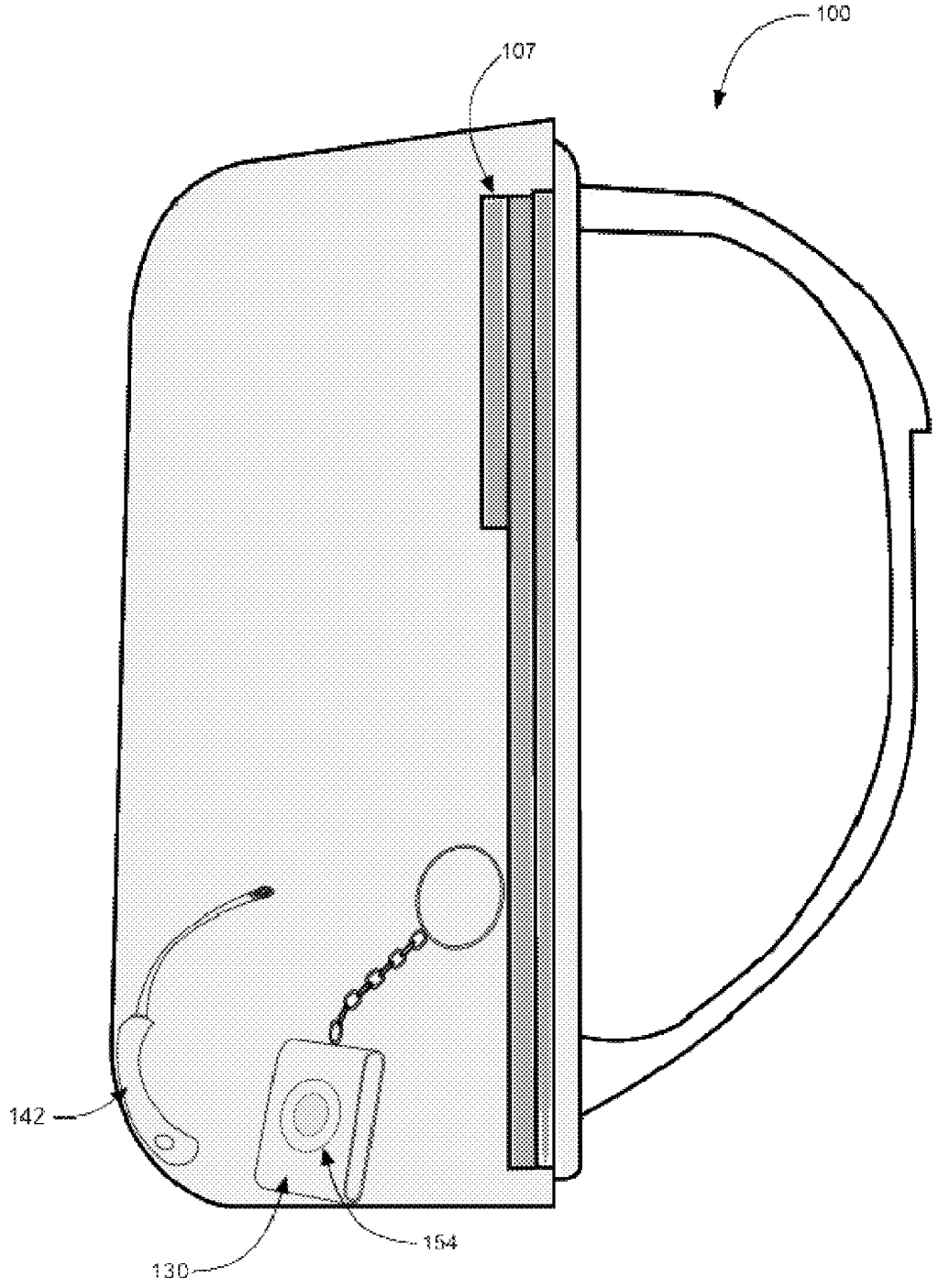
FIG. 4 is a transparent side view illustrating the bulletproof backpack assembly with multilayered bulletproof material and notification assembly therein.

Referring now to FIG. 4, showing a 'transparent' (see-through) side view illustrating bulletproof backpack assembly 104 with multilayered bulletproof material 107 and notification assembly 130 therein, according to an embodiment of the present invention.

User of bulletproof backpack assembly 104 is able to grip at least two pull handles 117, pulling to activate, and thereby deploying vest assembly 106, allowing a user to attach deployable bulletproof vest 110 to the body of a user with a series of hook and loop fasteners 119. GPS system 140 is able to use notification assembly 130 to alert authorities of an urgent distress of a user with respect to location. In normal wear (undeployed) the device does not appear other than a normal backpack so is non-conspicuous.

Bulletproof backpack system 100 may be sold as kit 440 comprising the following parts: at least one vest assembly 106, at least one deployment assembly 115, at least one notification assembly 130; and at least one set of user instructions. Bulletproof backpack system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

Figure 5:
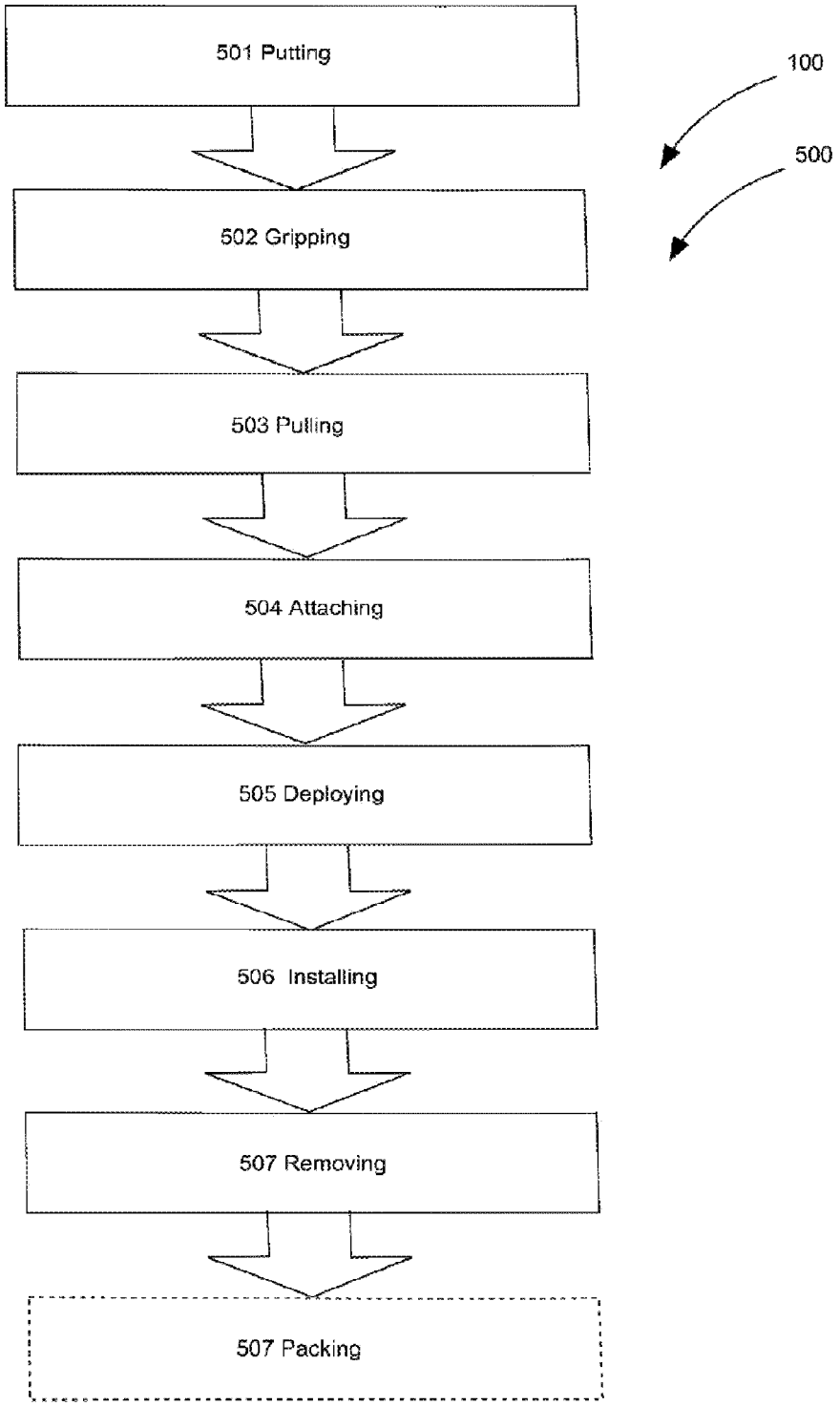
FIG. 5 is a flowchart illustrating a method of use for the bulletproof backpack assembly according to an embodiment of the present invention of FIGS. 1-4.

Referring now to FIG. 5, showing a flowchart illustrating a method of use 500 for bulletproof backpack system 100 according to an embodiment of the present invention of FIGS. 1-4.

A method of use 500 preferably comprises step one 501 putting on bulletproof backpack assembly 104, step two 502 gripping (at least two) pull handles 117, step three 503 pulling at least two pull handles 117, step four 504 deploying bulletproof backpack assembly 104, step five 505 installing deployable bulletproof vest 110, and step six 506 removing deployable bulletproof vest 110 when danger is no longer present. The method may further comprise step seven 507 packing deployable bulletproof vest 110 back into said bulletproof backpack assembly 104 (as needed).

It should be noted that step 507 is an optional step and may not be implemented in all cases. Optional steps of method 500 are illustrated using dotted lines in FIG. 5 so as to distinguish them from the other steps of method 500.

It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A bulletproof backpack system comprising:

a) a bulletproof backpack assembly having;

i) a vest assembly comprising;

(1) a deployable bulletproof vest; and (2) an attached bulletproof hood;

ii) a deployment assembly comprising;

(1) at least two pull handles; and (2) a series of hook and loop fasteners;

iii) a notification assembly comprising;

(1) a software program;

(2) an alarm system;

(3) a transmitter system;

(4) a receiver system;

(5) a GPS system, and (6) a hands-free headset;

b) wherein said bulletproof backpack system comprises said bulletproof backpack assembly;

c) wherein said bulletproof backpack assembly comprises said vest assembly, said deployment assembly, and said notification assembly in functional combination;

d) wherein said vest assembly comprises said deployable bulletproof vest, and said attached bulletproof hood in combination;

e) wherein said deployable bulletproof vest and said attached bulletproof hood are structured and arranged as a single, wearable item;

f) wherein said deployable bulletproof vest and said attached bulletproof hood are configured for storage within said bulletproof backpack assembly and further structured and arranged to deploy out of said bulletproof backpack as a single unit;

g) wherein said deployment assembly comprises said at least two pull handles and said series of hook and loop fasteners in combination;

h) wherein said deployment assembly is structured and arranged with said vest assembly to deploy said vest assembly out of said bulletproof backpack assembly in a rapid, lifesaving manner;

i) wherein said notification assembly comprises said software program, said alarm system, said transmitter system, said receiver system, said GPS system, and said hands-free headset structured and arranged in communicative combination;

j) wherein said software program is structured and arranged in communicative communication with said transmitter system, said receiver system, said GPS system, and said hands-free headset, wherein said communicative communication comprises transmission and reception of information to and from authorities when activated by said at least two pull handles;

k) wherein said at least two pull handles are structured and arranged within said bulletproof backpack assembly, whereby said user grips said at least two pull handles, pulling to activate, wherein said bulletproof backpack assembly is structured and arranged for deploying said deployable bulletproof vest and said attached bulletproof hood, positioning said deployable bulletproof vest and said attached bulletproof hood, whereby said user attaches said deployable bulletproof vest to a body of said user with said series of hook and loop fasteners and further structured and arranged such that said bulletproof backpack assembly further protects said body of said user, and said notification assembly is further structured and arranged with said at least two pull handles such that said notification assembly alerts authorities of an urgent distress and location of said user.

2. The bulletproof backpack system of claim 1 wherein said vest assembly comprises a hidden multilayered vest having bulletproof material.

3. The bulletproof backpack system of claim 2 wherein said bulletproof backpack assembly appears as a standard backpack until deployed by a user.

4. The bulletproof backpack system of claim 3 wherein said bulletproof backpack assembly is incorporated into the design of a standard backpack, wherein said attached bulletproof hood comprises said hook and loop fasteners to secure said attached bulletproof hood to a head of said user for protection from flying projectiles.

5. The bulletproof backpack system of claim 2 wherein said vest assembly comprises a pouch with said hook and loop fasteners to store said hands-free headset when not in use.

6. The bulletproof backpack system of claim 5 wherein said notification assembly is structured and arranged with said deployment assembly to be additionally activated, with a button in said pouch of said vest assembly.

7. The bulletproof backpack system of claim 6 wherein said notification assembly is structured and arranged with said deployment assembly and said hands-free headset to notify said authorities of imminent danger to said user.

8. The bulletproof backpack system of claim 7 wherein said hands-free headset is structured and arranged with said deployment assembly to remotely activate said notification assembly per need of said user.

9. The bulletproof backpack system of claim 8 wherein said hands-free headset communicates with said authorities in real time upon activation of said notification assembly.

10. The bulletproof backpack system of claim 7 wherein said notification assembly is structured and arranged with said deployment assembly to notify a family member upon activation of said notification assembly.

11. The bulletproof backpack system of claim 2 wherein said vest assembly protects said user from a front side and a back side when in use.

12. The bulletproof backpack system of claim 11 wherein said bulletproof backpack assembly is structured and arranged with a storage area to store items of said user's preference while also having said vest assembly, deployment assembly and notification assembly stored therein.

13. The bulletproof backpack system of claim 1 wherein said at least two pull handles comprise heavy duty nylon material for durability.

14. The bulletproof backpack system of claim 1 wherein said bulletproof backpack assembly is available in various colors to appeal to a wide variety of said users.

15. A bulletproof backpack system comprising:

a) a bulletproof backpack assembly having;

i) a vest assembly comprising;

(1) a deployable bulletproof vest; and (2) an attached bulletproof hood;

ii) a deployment assembly comprising;

(1) two pull handles; and (2) a series of hook and loop fasteners;

iii) a notification assembly comprising;

(1) a software program;

(2) an alarm system;

(3) a transmitter system;

(4) a receiver system;

(5) a GPS system, and (6) a hands-free headset;

b) wherein said bulletproof backpack system comprises said bulletproof backpack assembly;

c) wherein said bulletproof backpack assembly comprises said vest assembly, said deployment assembly, and said notification assembly in functional combination;

d) wherein said vest assembly comprises said deployable bulletproof vest, and said attached bulletproof hood in combination;

e) wherein said vest assembly comprises a hidden multilayered vest having bulletproof material;

f) wherein said vest assembly comprises a pouch with said hook and loop fasteners to store said hands free communication assembly when not in use;

g) wherein said attached bulletproof hood comprises said hook and loop fasteners to secure said attached bulletproof hood to a head of a user for protection from flying projectiles;

h) wherein said deployable bulletproof vest and said attached bulletproof hood combine and make a single, wearable item;

i) wherein said bulletproof backpack assembly appears as a standard backpack until deployed by said user;

j) wherein said bulletproof backpack assembly is able to store items of preference of said user while also having said vest assembly stored therein;

k) wherein said deployable bulletproof vest and said attached bulletproof hood reside within said bulletproof backpack assembly until use is required;

l) wherein said bulletproof backpack assembly is capable of protecting vital organs and head of said user when in use;

m) wherein said vest assembly protects said user from a front side and a back side when in use;

n) wherein said deployment assembly comprises said two pull handles and said series of hook and loop fasteners in combination;

o) wherein said two pull handles comprise heavy duty nylon material for durability;

p) wherein said deployment assembly allows said user to be able to deploy said vest assembly in a rapid, lifesaving manner;

q) wherein said notification assembly comprises said software program, said alarm system, said transmitter system, said receiver system, said GPS system, and said hands-free headset in communicative combination with an outside source;

r) wherein said notification assembly is able to be activated alone, with a button in said pouch of said vest assembly;

s) wherein said notification assembly is able to work in conjunction with said hands-free headset to notify said authorities of imminent danger to said user;

t) wherein said hands-free headset is able to remotely activate said notification assembly per need of said user;

u) wherein said software program works in communicative communication with said transmitter system, said receiver system, said GPS system, and said hands-free headset to allow transmission and reception of information from authorities when activated by said user;

v) wherein said hands-free headset allows said user to communicate with said authorities in real time upon activation of said notification assembly;

w) wherein said notification assembly is able to notify a family member upon activation of said notification assembly; and x) wherein said user of said bulletproof backpack assembly is able to grip said two pull handles, pulling to activate and thereby deploying said deployable bulletproof vest and said attached bulletproof hood, allowing said user to attach said deployable bulletproof vest to a body of said user with said series of hook and loop fasteners, said bulletproof backpack assembly for protection as needed, said bulletproof backpack assembly also able to provide use of said notification assembly to alert said authorities of an urgent distress of said user with respect to location.

16. The bulletproof backpack system of claim 15 further comprising a kit including: one said vest assembly, one said deployment assembly, one said notification assembly, and one set of user instructions for use.

* * * * *